US008130988B2

(12) United States Patent
Sako et al.

(10) Patent No.: US 8,130,988 B2
(45) Date of Patent: Mar. 6, 2012

(54) METHOD AND APPARATUS FOR REPRODUCING AUDIO SIGNAL

(75) Inventors: Yoichiro Sako, Tokyo (JP); Susumu Yabe, Tokyo (JP); Kosei Yamashita, Kanagawa (JP); Masayoshi Miura, Chiba (JP); Toshiro Terauchi, Tokyo (JP)

(73) Assignee: Sony Corporation, Tokyo (JP)

( * ) Notice: Subject to any disclaimer, the term of this patent is extended or adjusted under 35 U.S.C. 154(b) by 1128 days.

(21) Appl. No.: 11/248,681

(22) Filed: Oct. 11, 2005

(65) Prior Publication Data

US 2006/0083382 A1 Apr. 20, 2006

(30) Foreign Application Priority Data

Oct. 18, 2004 (JP) ..... 2004-302971

(51) Int. Cl.
*H04R 5/02* (2006.01)

(52) U.S. Cl. ..... 381/310; 381/17; 381/18; 381/19; 381/27; 381/61; 381/93; 381/300; 381/307

(58) Field of Classification Search ..... 381/310, 381/27, 17, 18, 19, 61, 93, 300, 307
See application file for complete search history.

(56) References Cited

U.S. PATENT DOCUMENTS

| | | | | |
|---|---|---|---|---|
| 6,584,202 | B1 | 6/2003 | Montag et al. | |
| 6,694,033 | B1 * | 2/2004 | Rimell et al. | 381/307 |
| 7,801,313 | B2 | 9/2010 | Sako et al. | |
| 2004/0151325 | A1 | 8/2004 | Hooley et al. | |
| 2005/0175197 | A1 * | 8/2005 | Melchior et al. | 381/310 |
| 2006/0126877 | A1 * | 6/2006 | Porschmann | 381/334 |
| 2009/0296954 | A1 | 12/2009 | Hooley et al. | |

FOREIGN PATENT DOCUMENTS

| | | | |
|---|---|---|---|
| CN | 1 402 952 | A | 3/2003 |
| DE | 10254404 | * | 6/2004 |
| JP | 04-132499 | | 5/1992 |
| JP | 2001-517005 | A | 10/2001 |
| JP | 2002-505058 | A | 2/2002 |
| JP | 2006-507727 | A | 3/2006 |
| WO | WO 2004/047485 | A1 | 6/2004 |
| WO | WO 2004047485 | * | 6/2004 |

OTHER PUBLICATIONS

Kates, James M.: "Optimum Loudspeaker Directional Patterns" Journal of the Audio Engineering Society, Audio Engineering Society, New York, NY. US, vol. 28, No. 11, Nov. 1, 1980, pp. 787-794.*
Geluk, R. J.: "A Monitor System based on Wave-Synthesis" Preprints of Papers Presented at the AES Convention, vol. 96, No. 3789, Feb. 26, 1994, pp. 1-16.*
Geluk, R.J, "A Monitor System based on Wave-Synthesis", Preprints of Papers Presented at the AES Convention, Feb. 26, 1994, p. 1-16, vol. 96 No. 3789.

(Continued)

*Primary Examiner* — Vivian Chin
*Assistant Examiner* — Paul Kim
(74) *Attorney, Agent, or Firm* — Wolf, Greenfield & Sacks, P.C.

(57) ABSTRACT

An audio signal is supplied to a loudspeaker array to perform wavefront synthesis. A virtual sound source is produced at an infinite distance using wavefront synthesis. A propagation direction of a sound wave emitted from the virtual sound source is changeable.

12 Claims, 11 Drawing Sheets

OTHER PUBLICATIONS

Boone, Marinus M et al., "Spatial Sound-Field Reproduction by Wave-Field Synthesis", Journal of Audio Engineering Society, Dec. 1, 1995, p. 1003-1012, vol. 43, No. 12, Audio Engineering Society, New York, NY, US.

Boone, Marinus M, "Acoustic rendering with wave field synthesis", ACM Siggraph and Eurographics Campfire: Accoustic Rendering for Virtual Enviornments, May 29, 2001, p. 1-9, Snowbird, Utah, US.

Bauer, Benjamin B.: "Broadening the area of stereophonic perception" Journal of the Audio Engineering Society, vol. 8, No. 2, Apr. 1, 1960, pp. 91-94.

Kates, James M.: "Optimum loudspeaker directional patterns" Journal of the Audio Engineering Society, Audio Engernieering Society, New York, NY, US, vol. 28, No. 11, Nov. 1, 1980, pp. 787-794.

"Speaker Placement" Oct. 10, 2004, Retrieved from the Internet: URL: http://web.archive.org/web/20041010051626/http://www.gcaudio.com/resources/howtos/speakerplacement.html.

* cited by examiner

METHOD AND APPARATUS FOR REPRODUCING AUDIO SIGNAL

CROSS REFERENCES TO RELATED APPLICATIONS

The present invention contains subject matter related to Japanese Patent Application JP 2004-302971 filed in the Japanese Patent Office on Oct. 18, 2004, the entire contents of which are incorporated herein by reference.

BACKGROUND OF THE INVENTION

1. Field of the Invention

The present invention relates to a method and apparatus for reproducing an audio signal.

2. Description of the Related Art

For example, in a system shown in FIG. 12, when an audio signal is supplied at an equal level to a left front loudspeaker SPL and a right front loudspeaker SPR with respect to a listener, a virtual sound source VSS is produced at the center on a line between the loudspeakers SPL and SPR, and the listener perceives sound as if the sound were output from the virtual sound source VSS (see PCT Japanese Translation Patent Publication No. 2002-505058).

SUMMARY OF THE INVENTION

In this system, however, the sound from the virtual sound source VSS is emitted all around the virtual sound source VSS, which is not fun for game or movie application.

It is therefore desirable to allow for directional emission of sound from a virtual sound source, like emission of a searchlight, so that a special effect can be presented to a listener.

An apparatus for reproducing an audio signal according to an embodiment of the present invention includes a processing circuit adapted to process an audio signal that is supplied to a loudspeaker array so that a virtual sound source is produced based on sound waves output from the loudspeaker array using wavefront synthesis, a setting circuit adapted to set the position of the virtual sound source at an infinite distance, and means for manually or automatically changing a propagation direction of a sound wave emitted from the virtual sound source.

According to an embodiment of the present invention, a sound wave from a loudspeaker array can be emitted directionally, like emission of a searchlight, in a target direction, and the emission direction can be changed. Therefore, a special effect, such as sound movement perception, can be given to a listener.

BRIEF DESCRIPTION OF THE DRAWINGS

FIG. 12 is a diagram showing general stereo reproduction.

DESCRIPTION OF THE PREFERRED EMBODIMENTS

According to an embodiment of the present invention, a virtual sound source is produced using wavefront synthesis, and the position of the virtual sound source is controlled to propagate sound waves as parallel plane waves.

[1] Sound Field Reproduction

Figure 1:
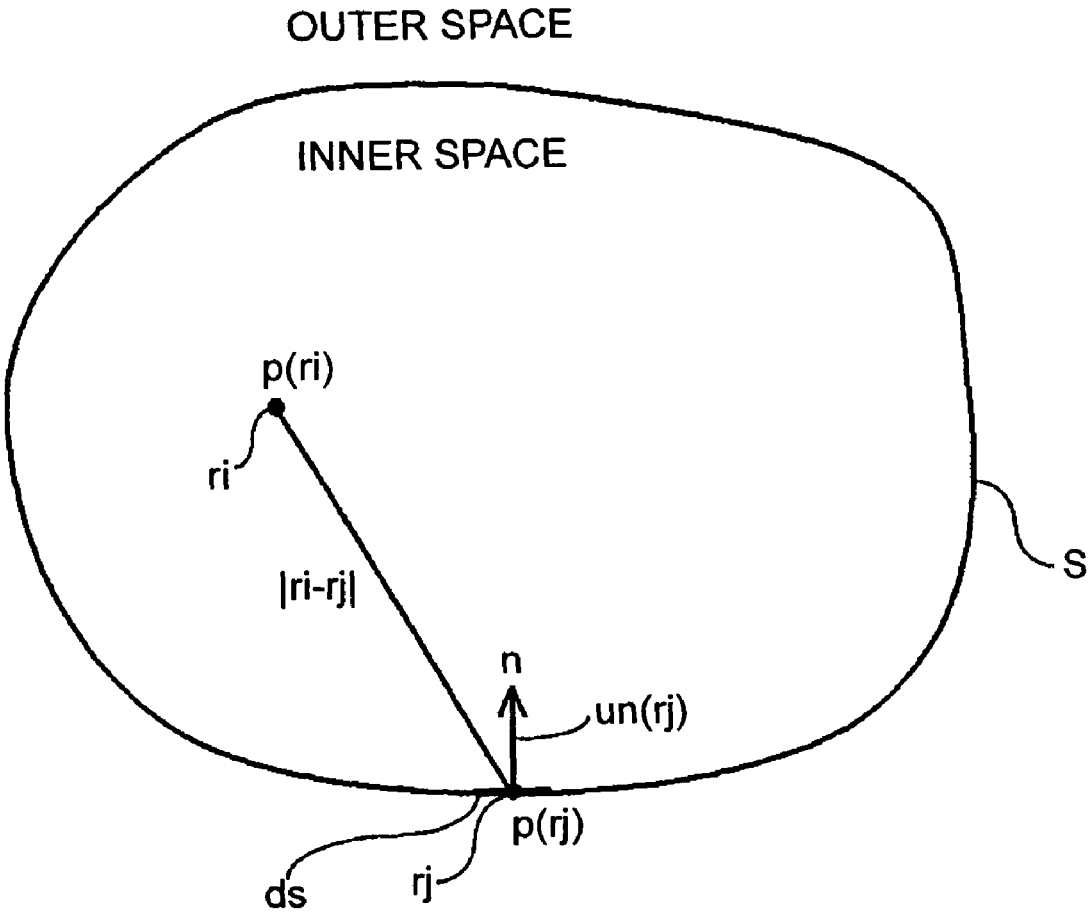
FIG. 1 is a diagram of an acoustic space to show an embodiment of the present invention.

Referring to FIG. 1, a closed surface S surrounds a space having an arbitrary shape, and no sound source is included in the closed surface S. The following symbols are used to denote inner and outer spaces of the closed surface S:

p(ri): sound pressure at an arbitrary point ri in the inner space p(rj): sound pressure at an arbitrary point rj on the closed surface S ds: small area including the point rj n: vector normal to the small area ds at the point rj un(rj): particle velocity at the point rj in the direction of the normal n ω: angular frequency of an audio signal ρ: density of air v: velocity of sound (=340 m/s)

k: ω/v

The sound pressure p(ri) is determined using Kirchhoff's integral formula as follows:

$$p(ri) = \int_s \left( p(rj)\frac{\partial Gij}{\partial n} + j\omega\rho un(rj)Gij \right) ds \qquad \text{Eq. (1)}$$

$$\text{where } Gij = \frac{\exp(-jk|ri - rj|)}{4\pi|ri - rj|}$$

Eq. (1) means that appropriate control of the sound pressure p(rj) at the point rj on the closed surface S and the particle velocity un(rj) at the point rj in the direction of the normal vector n allows for reproduction of a sound field in the inner space of the closed surface S.

Figure 2A:
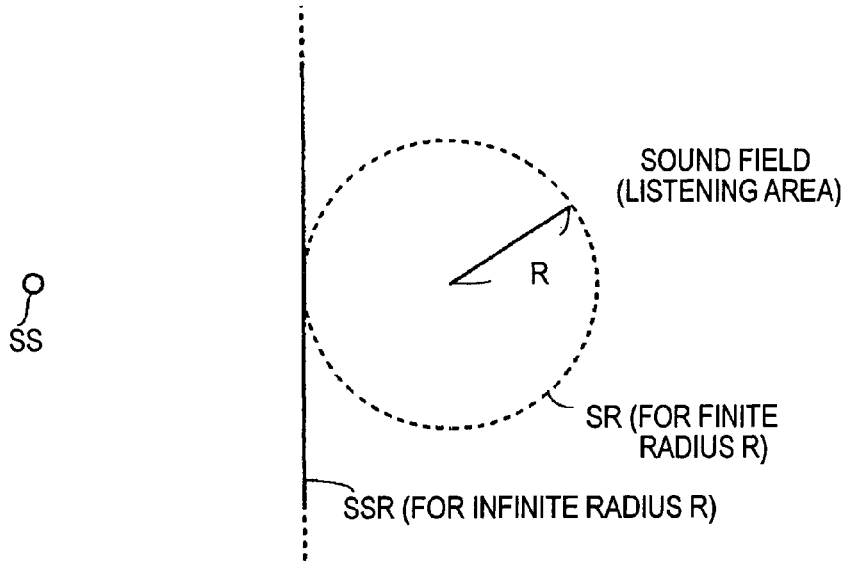
FIGS. 2A and 2B are diagrams of acoustic spaces to show an embodiment of the present invention.

For example, a sound source SS is shown in the left portion of FIG. 2A, and a closed surface SR (indicated by a broken circle) that surrounds a spherical space having a radius R is shown in the right portion of FIG. 2A. As described above, with the control of the sound pressure on the closed surface SR and the particle velocity un(rj), a sound field generated in the inner space of the closed surface SR by the sound source SS can be reproduced without the sound source SS. A virtual sound source VSS is generated at the position of the sound source SS. Accordingly, the sound pressure and particle velocity on the closed surface SR are appropriately controlled, thereby allowing a listener within the closed surface SR to perceive sound as if the virtual sound source VSS were at the position of the sound source SS.

When the radius R of the closed surface SR is infinite, a planar surface SSR rather than the closed surface SR is defined, as indicated by a solid line shown in FIG. 2A. Also, with the control of the sound pressure and particle velocity on the planar surface SSR, a sound field generated in the inner space of the closed surface SR, or generated in the region right to the planar surface SSR, by the sound source SS can be reproduced without the sound source SS. Also in this case, a virtual sound source VSS is generated at the position of the sound source SS.

Therefore, appropriately control of the sound pressure and particle velocity at all points on the planar surface SSR allows the virtual sound source VSS to be placed to the left of the planar surface SSR, and allows a sound field to be placed to the right. The sound field can be a listening area.

Figure 2B:
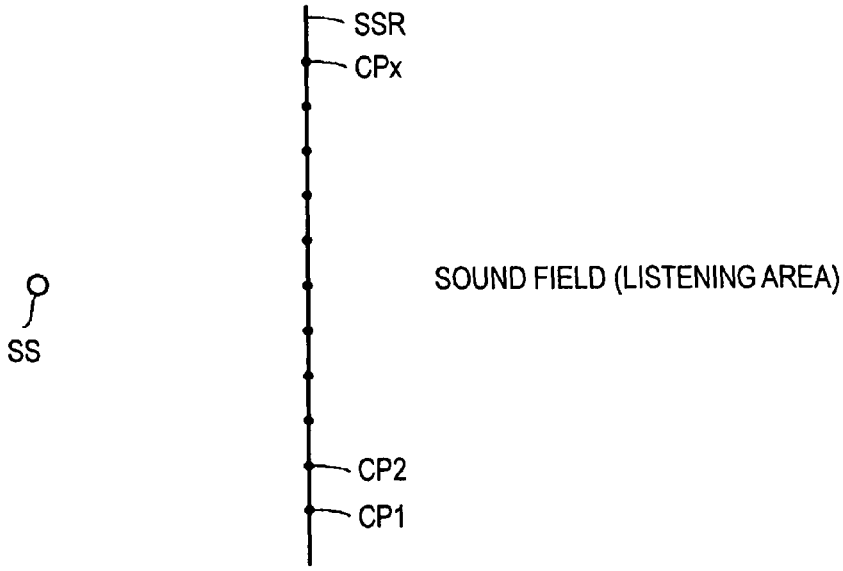

Actually, as shown in FIG. 2B, the planar surface SSR is finite in width, and the sound pressure and particle velocity at finite points CP1 to CPx on the planar surface SSR are controlled. In the following description, the points CP1 to CPx at which the sound pressure and the particle velocity on the planar surface SSR are controlled are referred to as "control points."

Figure 3:
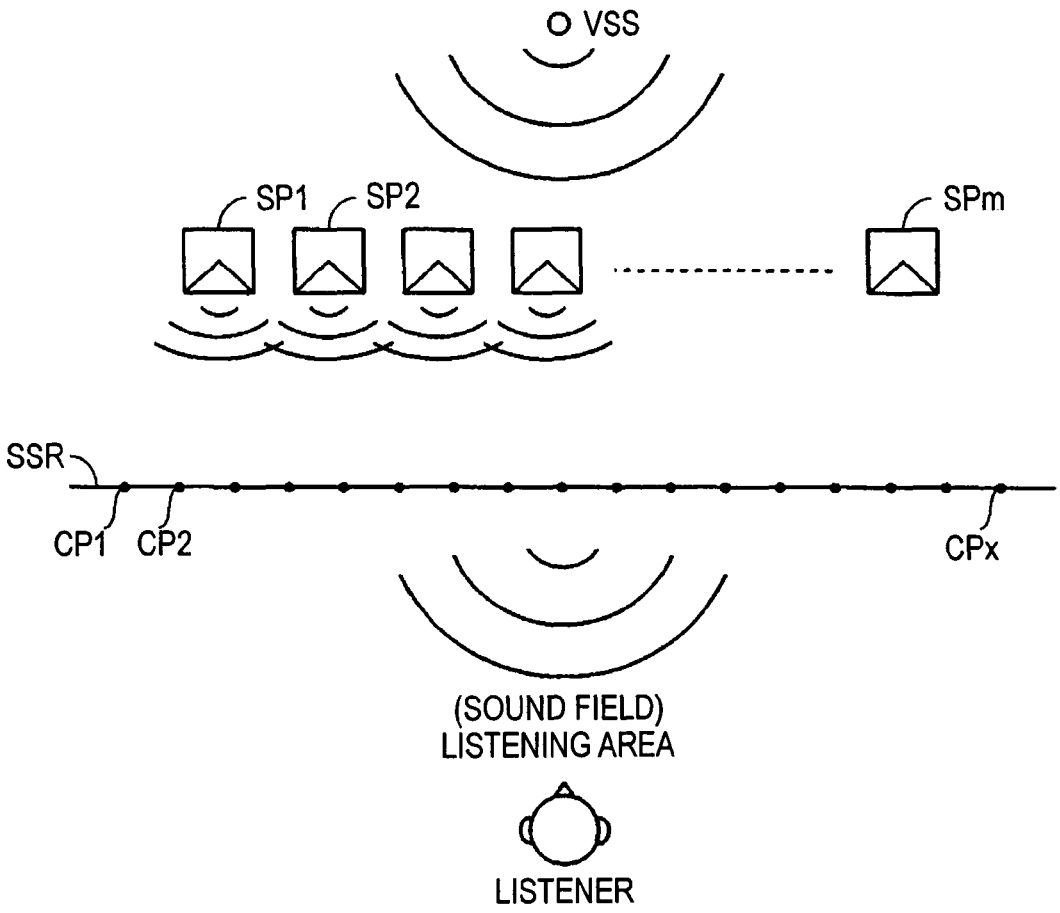
FIG. 3 is a diagram showing an exemplary acoustic space according to an embodiment of the present invention.

[2] Control of Sound Pressure and Particle Velocity at Control Points CP1 to CPx In order to control the sound pressure and the particle velocity at the control points CP1 to CPx, as shown in FIG. 3, the following procedure is performed:

(A) A plurality of m loudspeakers SP1 to SPm are placed near the sound source with respect to the planar surface SSR, for example, in parallel to the planar surface SSR. A loudspeaker array is a collection of the loudspeakers SP1 to SPm.

(B) An audio signal supplied to the loudspeakers SP1 to SPm is controlled to control the sound pressure and particle velocity at the control points CP1 to CPx.

In this way, sound waves output from the loudspeakers SP1 to SPm are reproduced using wavefront synthesis as if the sound waves were output from the virtual sound source VSS to produce a desired sound field. The position at which the sound waves output from the loudspeakers SP1 to SPm are reproduced using wavefront synthesis is on the planar surface SSR. Thus, in the following description, the planar surface SSR is referred to as a "wavefront-synthesis surface."

[3] Simulation of Wavefront Synthesis

Figure 4B:
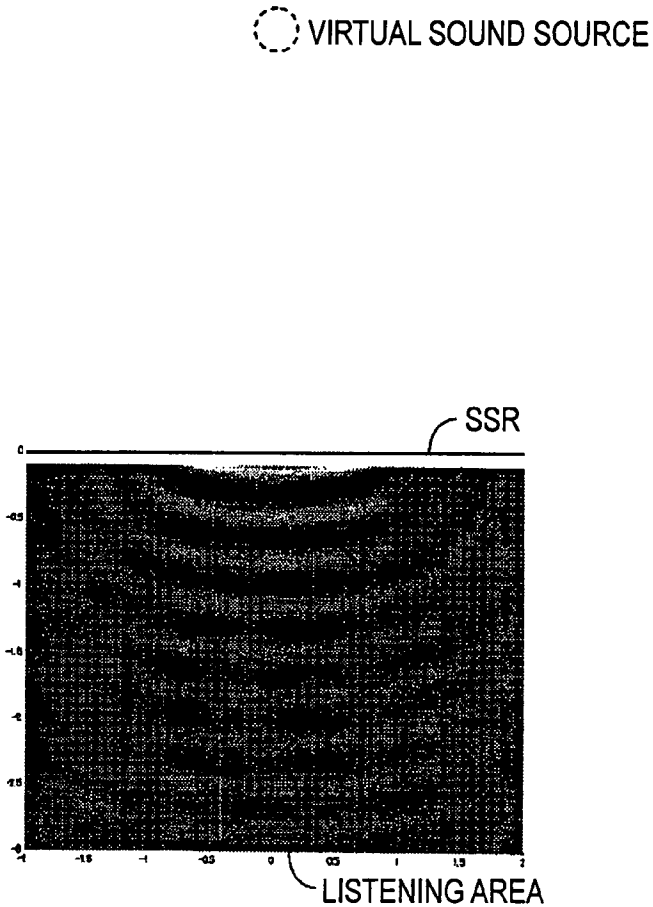
FIGS. 4A and 4B are simulation diagrams of wavefront synthesis according to an embodiment of the present invention.
Figure 4A:
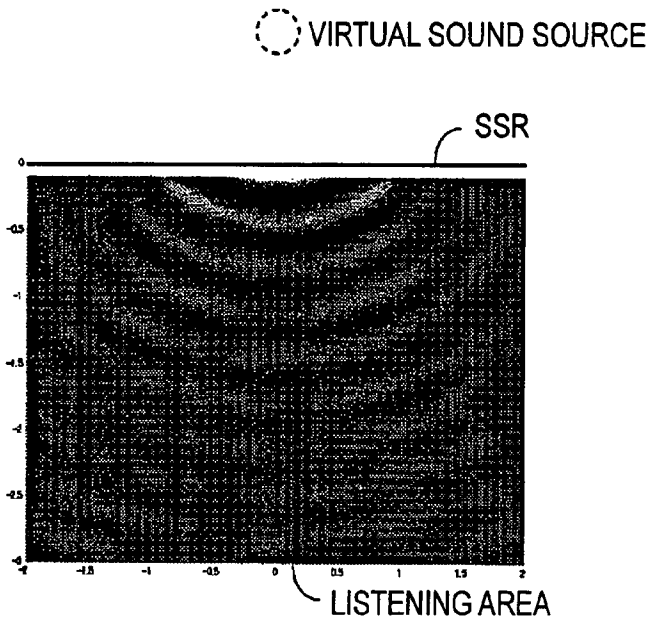

FIGS. 4A and 4B show exemplary computer-based simulations of wavefront synthesis. Although processing of an audio signal supplied to the loudspeakers SP1 to SPm is discussed below, the simulations are performed using the following values:

Number m of loudspeakers: 16

Distance between loudspeakers: 10 cm

Diameter of each loudspeaker: 8 cmϕ

Position of a control point: 10 cm apart from each loudspeaker towards the listener Number of control points: 116 (spaced at 1.3-cm intervals in a line)

Position of the virtual sound source shown in FIG. 4A: 1 m in front of the listening area Position of the virtual sound source shown in FIG. 4B: 3 m in front of the listening area Size of the listening area: 2.9 m (deep)×4 m (wide)

When the distance between the loudspeakers, which is expressed in meters (m), is represented by w, the velocity of sound (=340 m/s) is represented by v, and the upper limit frequency for reproduction, which is expressed in hertz (Hz), is represented by fhi, the following equation is defined:

$$fhi=v/(2w)$$

It is therefore preferable to reduce the distance w between the loudspeakers SP1 to SPm (m=16). Thus, the smaller the diameter of the loudspeakers SP1 to SPm, the better.

When the audio signal supplied to the loudspeakers SP1 to SPm is a digitally processed signal, preferably, the distance between the control points CP1 to CPx is not more than ¼ to ⅕ of the wavelength corresponding to the sampling frequency in order to suppress sampling interference. In these simulations, a sampling frequency of 8 kHz is provided, and the distance between the control points CP1 to CPx is 1.3 cm, as described above.

In FIGS. 4A and 4B, the sound waves output from the loudspeakers SP1 to SPm are reproduced using wavefront synthesis as if they were output from the virtual sound source VSS, and a clear wave pattern is shown in the listening area. That is, wavefront synthesis is appropriately performed to produce a target virtual sound source VSS and a sound field.

In the simulation shown in FIG. 4A, the position of the virtual sound source VSS is 1 m in front of the listening area, and the virtual sound source VSS is relatively close to the wavefront-synthesis surface SSR. The curvature of the wave pattern is therefore small. In the simulation shown in FIG. 4B, on the other hand, the position of the virtual sound source VSS is 3 m in front of the listening area, and the virtual sound source VSS is farther from the wavefront-synthesis surface SSR than that shown in FIG. 4A. The curvature of the wave pattern is therefore larger than that shown in FIG. 4A. Thus, the sound waves become closer to the parallel plane waves as the virtual sound source VSS is farther from the wavefront-synthesis surface SSR.

[4] Parallel-Plane-Wave Sound Field

Figure 5A:
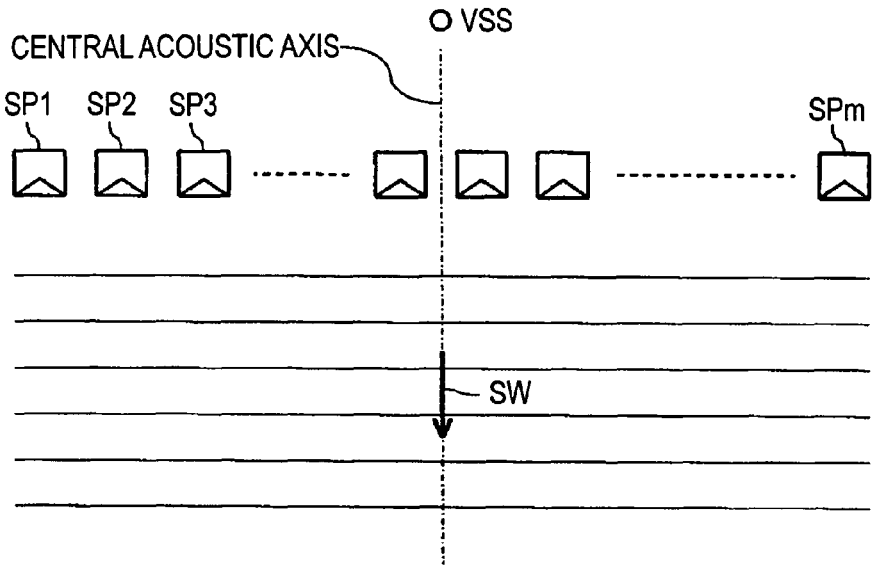
FIGS. 5A and 5B are diagrams showing wavefronts according to an embodiment of the present invention.

As shown in FIG. 5A, a virtual sound source VSS is produced based on the outputs from the loudspeakers SP1 to SPm using wavefront synthesis. The virtual sound source VSS is placed at an infinite distance from the loudspeakers SP1 to SPm (the wavefront-synthesis surface SSR), and is placed on the acoustic axis in the center of the loudspeakers SP1 to SPm. As is apparent from the simulations of wavefront synthesis in the previous section (Section [3]), a sound wave (wave pattern) SW obtained by wavefront synthesis also has an infinite curvature, and the sound wave SW propagates as parallel plane waves along the acoustic axes of the loudspeakers SP1 to SPm.

Figure 5B:
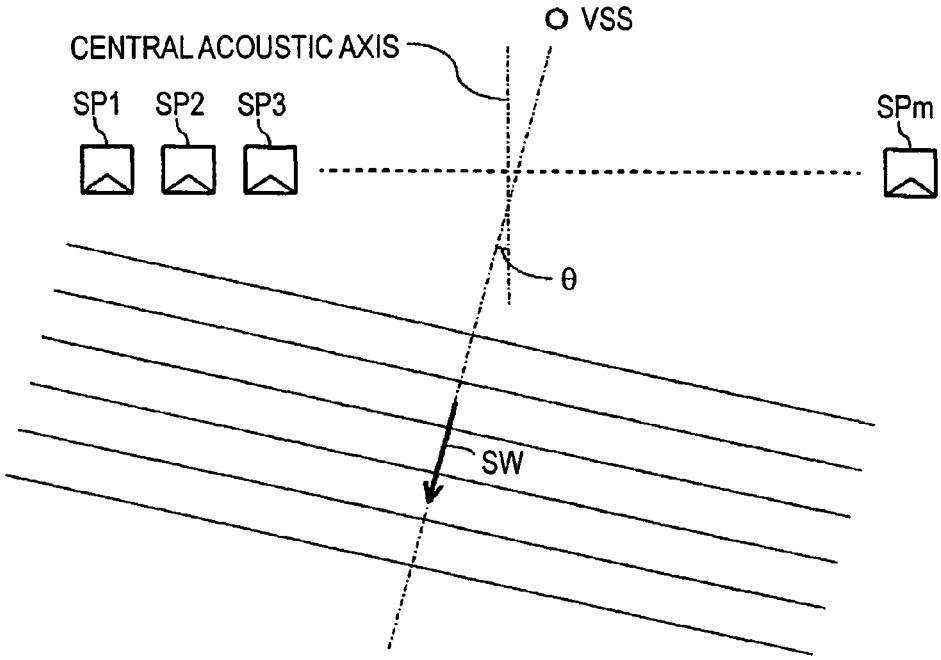

As shown in FIG. 5B, on the other hand, when the virtual sound source VSS is placed at an infinite distance from the loudspeakers SP1 to SPm, if the position of the virtual sound source VSS is offset from the central acoustic axis of the loudspeakers SP1 to SPm, the sound wave SW obtained by wavefront synthesis propagates as parallel plane waves, and the angle θ defined between the propagation direction of the sound wave SW and the acoustic axis of the loudspeakers SP1 to SPm is set to $\theta \neq 0$.

Since the sound wave SW shown in FIGS. 5A and 5B includes parallel plane waves, the sound wave SW has the same sound pressure throughout a sound field generated by the sound wave SW, and there is no difference in sound pressure level. Therefore, the volume levels are the same throughout the sound field of the sound wave SW.

In the following description, the angle θ is referred to as a "yaw angle," where θ=0 is set when the propagation direction of the sound wave SW is along the central acoustic axis of the loudspeakers SP1 to SPm and θ>0 is set for the clockwise direction.

[5] Wavefront Synthesis Algorithm

Figure 6:
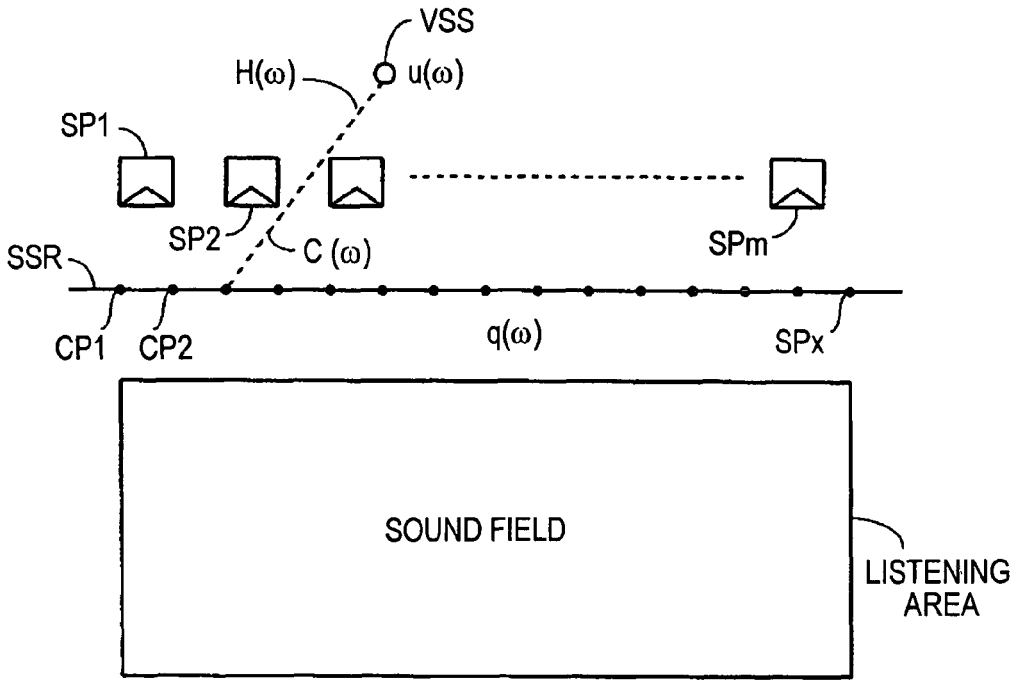
FIG. 6 is a diagram of an acoustic space to show an embodiment of the present invention.

In FIG. 6, the following symbols are used:

u(ω): output signal of the virtual sound source VSS, i.e., original audio signal H(ω): transfer function to be convoluted with the signal u(ω) to realize appropriate wavefront synthesis C(ω): transfer function from the loudspeakers SP1 to SPm to the control points CP1 to CPm q(ω): signal which is actually reproduced at the control points CP1 to CPx using wavefront synthesis The reproduced audio signal q(ω) is determined by convoluting the transfer functions C(ω) and H(ω) into the original audio signal u(ω), and is given by the following equation:

$$q(\omega)=C(\omega)\cdot H(\omega)\cdot u(\omega)$$

The transfer function C(ω) is defined by determining transfer functions from the loudspeakers SP1 to SPm to the control points CP1 to CPx.

With the control of the transfer function H(ω), appropriate wavefront synthesis is performed based on the reproduced audio signal q(ω), and the parallel plane waves shown in FIGS. 5A and 5B are produced.

[6] Synthesizing Circuit

Figure 7:
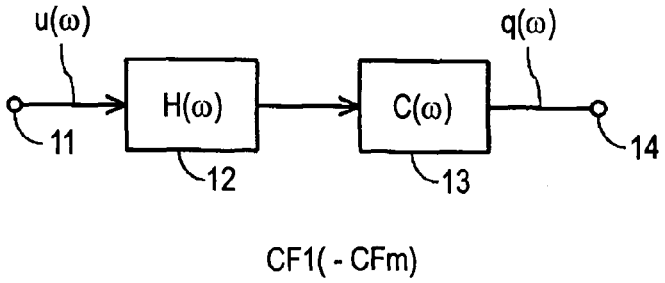
FIG. 7 is a schematic diagram showing a circuit according to an embodiment of the present invention.

A synthesizing circuit for converting or synthesizing the original audio signal u(ω) into the reproduced audio signal q(ω) according to the wavefront synthesis algorithm described in the previous section (Section [5]) may have an example structure shown in FIG. 7. This synthesizing circuit is provided for each of the loudspeakers SP1 to SPm, and synthesizing circuits CF1 to CFm are provided.

In each of the synthesizing circuits CF1 to CFm, the original digital audio signal u(ω) is sequentially supplied to digital filters 12 and 13 via an input terminal 11 to generate the reproduced audio signal q(ω), and the signal q(ω) is supplied to the corresponding loudspeaker in the loudspeakers SP1 to SPm via an output terminal 14. The synthesizing circuits CF1 to CFm may be digital signal processors (DSPs).

Accordingly, the virtual sound source VSS is produced based on the outputs of the loudspeakers SP1 to SPm. The position of the virtual sound source VSS is changed by setting the transfer functions C(ω) and H(ω) of the filters 12 and 13 to predetermined values, and, for example, the virtual sound source VSS can be placed at an infinite distance from the loudspeakers SP1 to SPm. As shown in FIG. 5A or 5B, the yaw angle θ can be changed by changing the transfer functions C(ω) and H(ω) of the filters 12 and 13.

[7] First Embodiment

Figure 8:
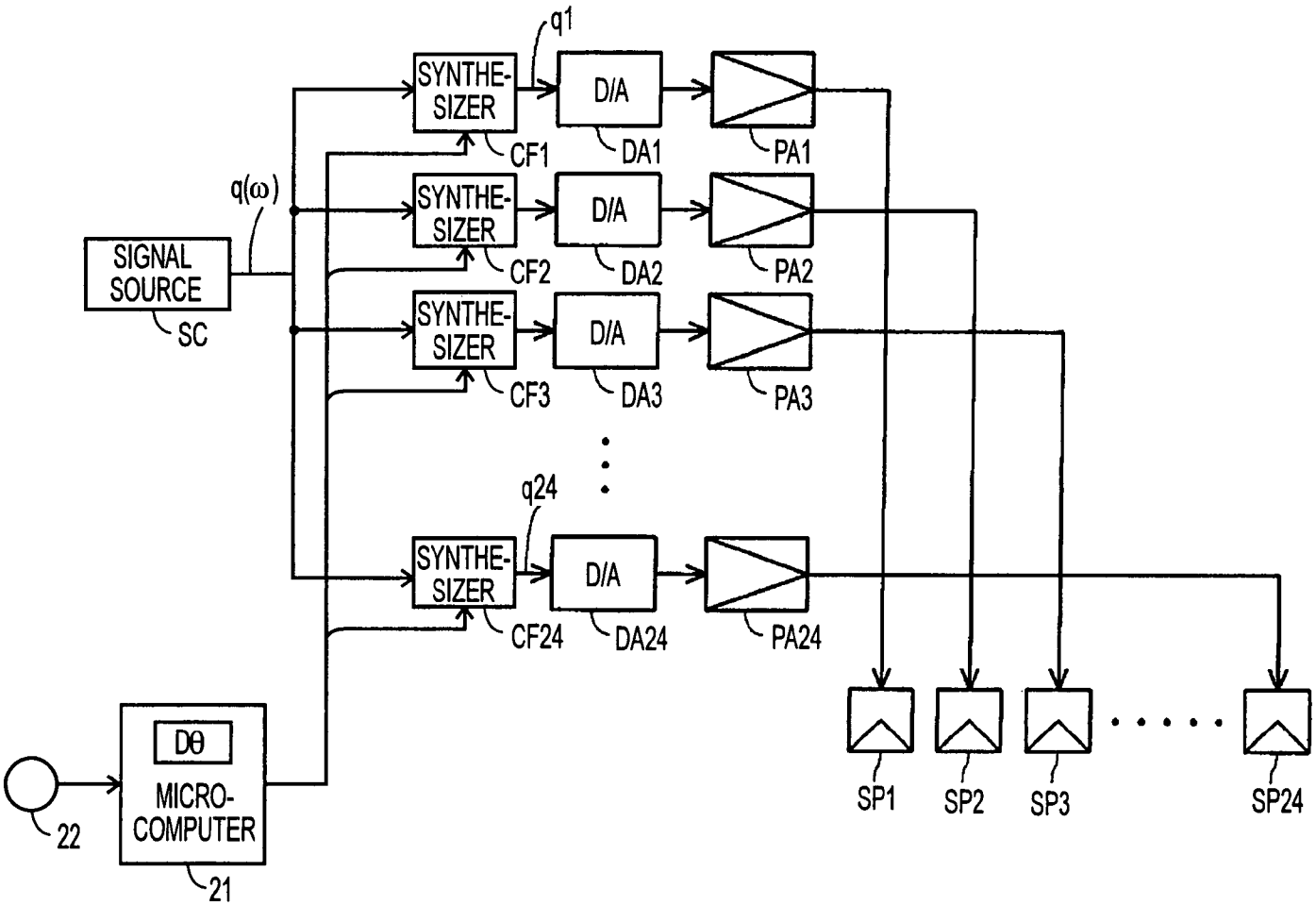
FIG. 8 is a block diagram of a reproduction apparatus according to an embodiment of the present invention.

FIG. 8 shows a reproduction apparatus according to a first embodiment of the present invention. The reproduction apparatus places the virtual sound source VSS at an infinite distance from the wavefront-synthesis surface SSR according to the procedure described in the previous sections (Sections [1] to [6]) so that the sound wave output from the virtual sound source VSS propagates as parallel plane waves and the yaw angle θ is variable.

In FIG. 8, the number of m loudspeakers SP1 to SPm is 24 (m=24). For example, as shown in FIG. 3, the loudspeakers SP1 to SP24 are horizontally placed in front of the listener to produce a loudspeaker array.

A digital audio signal u(ω) is obtained from a signal source SC. The signal u(ω) is supplied to the synthesizing circuits CF1 to CF24 shown in FIG. 7, and is converted into audio signals q1 to q24 corresponding to the reproduced audio signal q(ω). The signals q1 to q24 are supplied to digital-to-analog (D/A) converter circuits DA1 to DA24, and are converted into analog audio signals. The analog signals are supplied to the loudspeakers SP1 to SP24 via power amplifiers PA1 to PA24.

The reproduction apparatus further includes a microcomputer 21 serving as a control circuit for setting the position of the virtual sound source VSS at an infinite distance and changing the yaw angle θ. The microcomputer 21 has data Dθ for setting the yaw angle θ. The yaw angle θ can be changed in steps of 5° up to, for example, +90° from −90°. The microcomputer 21 therefore includes 24×37 data sets Dθ which correspond to the number of signals q1 to q24, i.e., 24, and the number of yaw angles θ that can be set, i.e., 37, and one of these data sets Dθ is selected by operating an operation switch 22.

The selected data set Dθ is supplied to the digital filters 12 and 13 in each of the synthesizing circuits CF1 to CF24, and the transfer functions H(ω) and C(ω) of the digital filters 12 and 13 are controlled.

With this structure, the digital audio signal u(ω) output from the signal source SC is converted by the synthesizing circuits CF1 to CF24 into the signals q1 to q24, and audio signals into which the signals q1 to q24 are digital-to-analog converted are supplied to the loudspeakers SP1 to SP24. Therefore, as shown in FIG. 9B, a sound wave SW corresponding to the audio signal u(ω) is output as parallel plane waves from the loudspeakers SP1 to SP24.

Figure 9A:
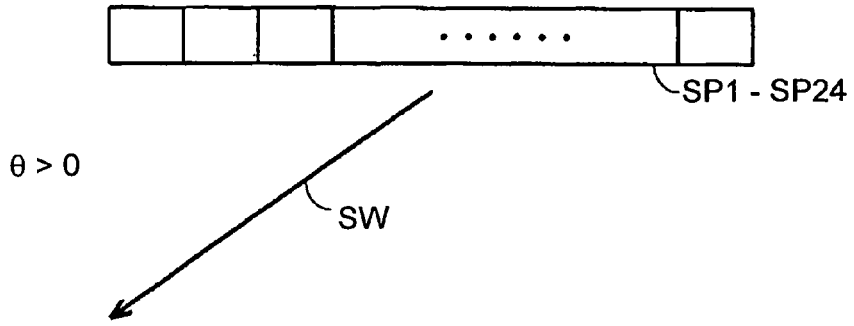
FIGS. 9A to 9C are diagrams showing the operation of the reproduction apparatus according to the embodiment of the present invention.
Figure 9B:
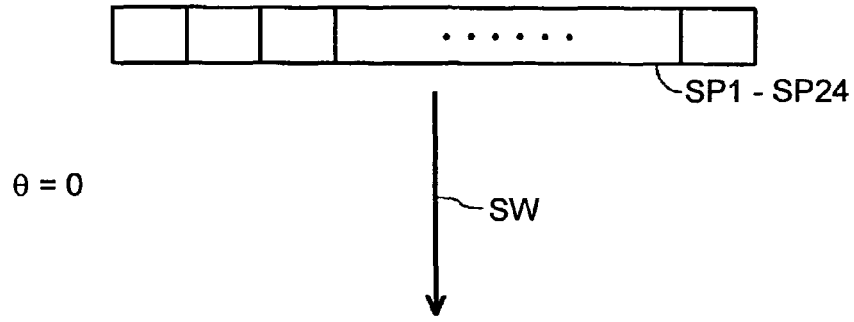
Figure 9C:
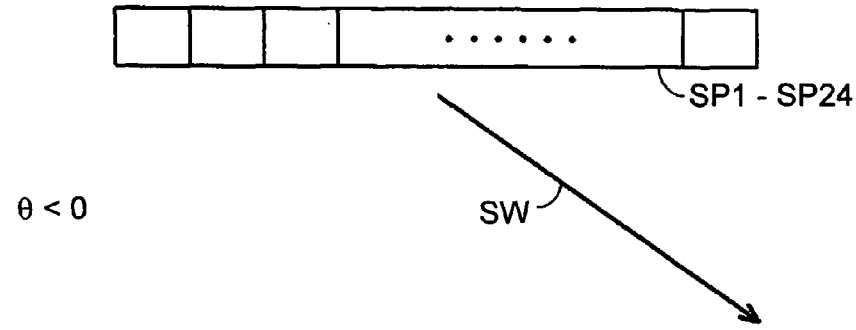

When the operation switch 22 is operated to change the data Dθ set in the synthesizing circuits CF1 to CF24, as shown in FIGS. 9A to 9C, the yaw angle θ of the sound wave SW, i.e., the propagation direction of the sound wave SW, changes depending on the data Dθ. Therefore, by operating the operation switch 22, the sound wave SW from the virtual sound source VSS can be emitted directionally, like emission of a searchlight, in a target direction. This emission direction can be changed, thereby giving a special effect, such as sound movement perception, to the listener.

[8] Second Embodiment

Figure 10:
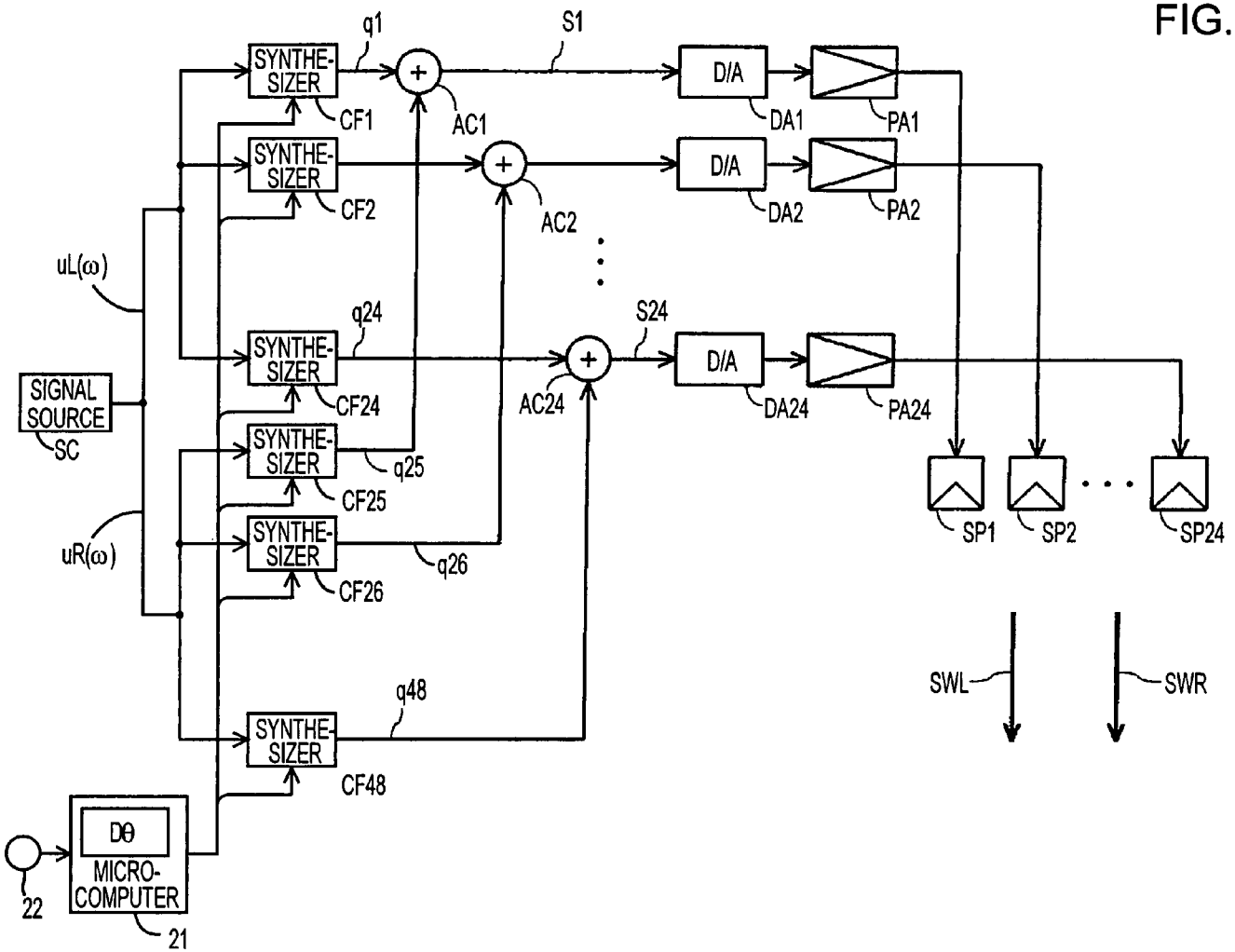
FIG. 10 is a block diagram of a reproduction apparatus according to an embodiment of the present invention.

FIG. 10 shows a reproduction apparatus according to a second embodiment of the present invention. In the second embodiment, a plurality of audio signals, namely, two-channel stereo audio signals L and R, are processed.

As in the first embodiment described in the previous section (Section [7]), the number of m loudspeakers SP1 to SPm is 24 (m=24), and, for example, the loudspeakers SP1 to SP24 are horizontally placed in front of the listener in the manner shown in FIG. 3 to produce a loudspeaker array.

Left- and right-channel digital audio signals uL(ω) and uR(ω) are obtained from a signal source SC. The signal uL(ω) is supplied to synthesizing circuits CF1 to CF24, and is converted into audio signals q1 to q24 corresponding to the reproduced audio signal q(ω). The signals q1 to q24 are supplied to adding circuits AC1 to AC24.

The signal uR(ω) is supplied to synthesizing circuits CF25 to CF48 to generate audio signals q25 to q48 corresponding to the reproduced audio signal q(ω), and the signals q25 to q48 are supplied to the adding circuits AC1 to AC24. The adding circuits AC1 to AC24 output added signals S1 to S24 of the signals q1 to q24 and the signals q25 to q48. The added signals S1 to S24 are given by the following equations:

$$S1 = q1 + q25$$
$$S2 = q2 + q26$$
$$\cdots$$
$$S24 = q24 + q48$$

The added signals S1 to S24 are supplied to D/A converter circuits DA1 to DA24, and are converted into analog audio signals. The analog signals are supplied to the loudspeakers SP1 to SP24 via power amplifiers PA1 to PA24.

A microcomputer 21 includes 48×37 data sets Dθ for defining the yaw angle θ which correspond to the number of signals q1 to q48, i.e., 48, and the number of yaw angles θ that can be set, i.e., 37. An operation switch 22 is operated to select one of these data sets Dθ, and the selected data set Dθ is supplied as control data of the transfer functions H(ω) and C(ω) to the synthesizing circuits CF1 to CF48.

With this structure, since the added signals S1 to S24 are added signals of the audio signals q1 to q24 in the left channel and the audio signals q25 to q48 in the right channel, a left-channel sound wave SWL and a right-channel sound wave SWR are linear added and output from the loudspeakers SP1 to SP24.

The data Dθ of the yaw angle θ is set so that a virtual sound source of the sound wave SWL is shifted to the left with respect to the central acoustic axis of the loudspeakers SP1 to SP24 and a virtual sound source of the sound wave SWR is shifted to the right with respect to the central acoustic axis of the loudspeakers SP1 to SP24, thereby reproducing the sound waves SWL and SWR in stereo.

When the operation switch 22 is operated to select the data Dθ, the yaw angles θ of the sound waves SWL and SWR are simultaneously changed by the same angle, and the propagation directions of the sound waves SWL and SWR are also changed while they are still parallel to each other. The reproduction apparatus according to the second embodiment can therefore emit the sound waves SWL and SWR directionally, like emission of a searchlight, in a target direction, and can also change the emission directions.

[9] Third Embodiment

Figure 11:
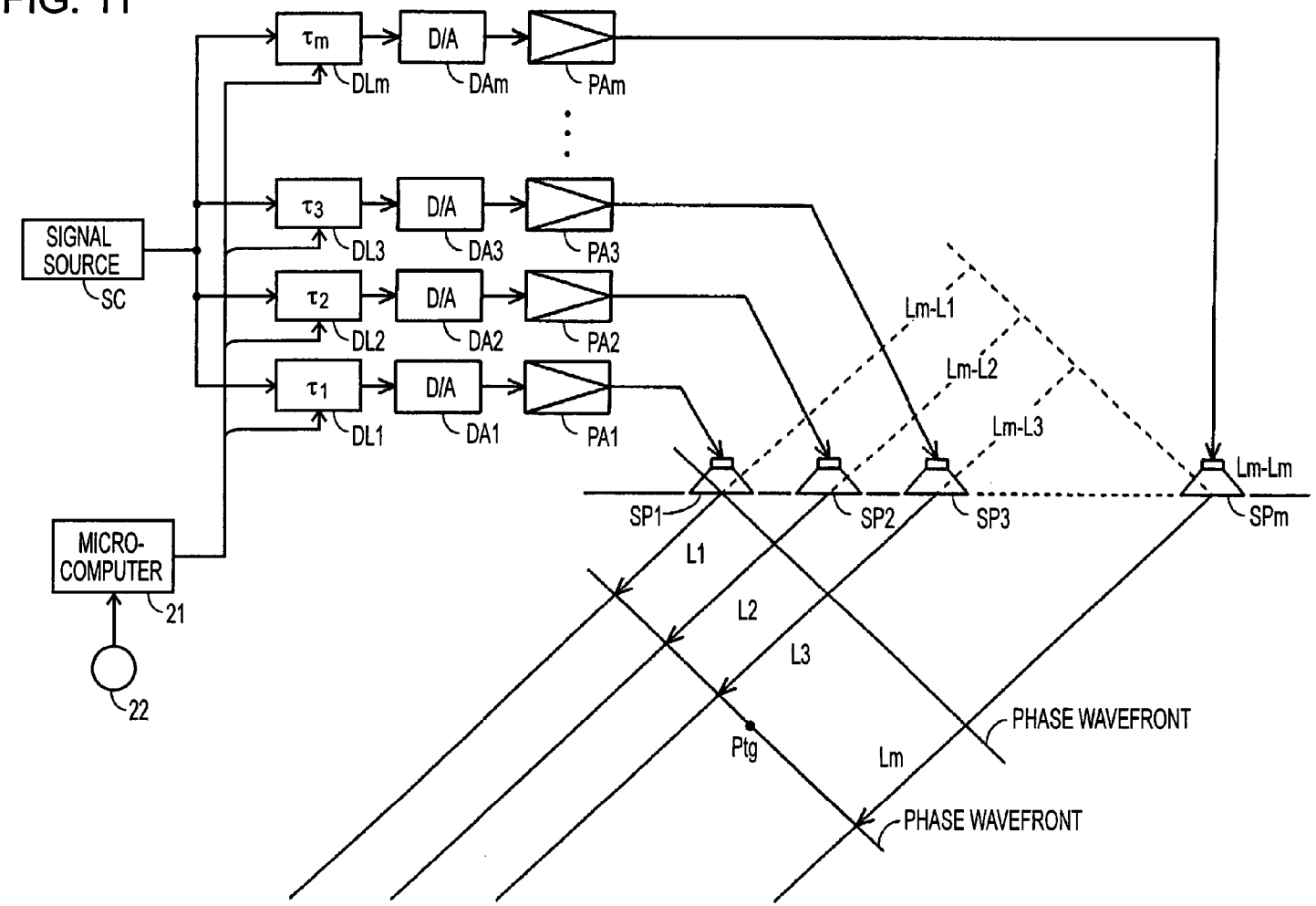
FIG. 11 is a block diagram of a reproduction apparatus according to an embodiment of the present invention.
Figure 1:
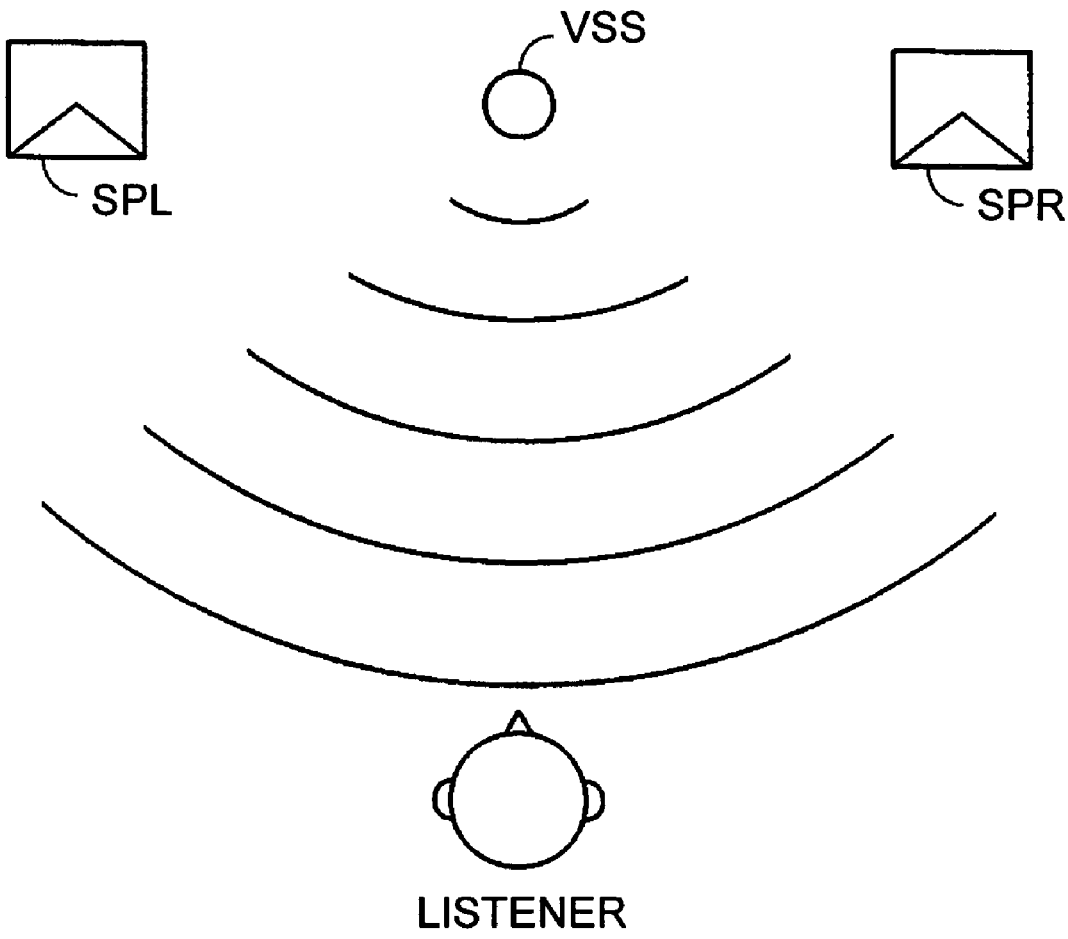

FIG. 11 shows a reproduction apparatus according to a third embodiment of the present invention. This reproduction apparatus achieves a simplified structure by controlling the time and phase of a sound wave output from each of the loudspeakers SP1 to SP24.

Also in the third embodiment, for example, loudspeakers SP1 to SPm are horizontally placed in front of the listener in the manner shown in FIG. 3 to produce a loudspeaker array. A digital audio signal is obtained from a signal source SC, and is supplied to delay circuits DL1 to DLm to delay the signal by predetermined periods of time τ1 to τm. The delayed audio signals are converted by D/A converter circuits DA1 to DAm into analog audio signals, and are supplied to the loudspeakers SP1 to SPm via power amplifiers PA1 to PAm. The delay periods of time τ1 to τm of the delay circuits DL1 to DLm are discussed below.

Thus, at any place, the sound waves output from the loudspeakers SP1 to SPm are synthesized, and the sound pressure of the synthesized wave is determined. In FIG. 11, in a sound field produced by the loudspeakers SP1 to SPm, a predetermined point Ptg is a point at which sound from the signal source SC is to be listened to and at which the sound is reinforced more than any other point. When the distances from the loudspeakers SP1 to SPm to the sound-reinforced point Ptg are represented by L1 to Lm and the velocity of sound is represented by v, the delay periods of time τ1 to τm of the delay circuits DL1 to DLm are given by the following equations:

$$\tau 1 = (Lm - L1)/v$$
$$\tau 2 = (Lm - L2)/v$$
$$\tau 3 = (Lm - L3)/v$$
$$\cdots$$
$$\tau m = (Lm - Lm)/v = 0$$

When the audio signal output from the signal source SC is converted into sound waves output from the loudspeakers SP1 to SPm, these sound waves are delayed by the delay periods of time τ1 to τm given by the above-noted equations and are output. Therefore, these sound waves arrive at the sound-reinforced point Ptg at the same time, and the sound pressure is higher at the sound-reinforced point Ptg than any other point.

That is, in-phase wavefronts of the sound waves output from the loudspeakers SP1 to SPm are produced at the sound-reinforced point Ptg, and a sound wave obtained by synthesizing these sound waves has directionality of which the center is the sound-reinforced point Ptg.

The position of the sound-reinforced point Ptg moves by operating the operation switch 22 to change the delay periods of time τ1 to τm using the microcomputer 21. Therefore, the sound waves from the loudspeakers SP1 to SPm can be emitted directionally, like emission of a searchlight, in a target direction, and this emission direction can be changed.

[10] Other Embodiments

While the plurality of m loudspeakers SP1 to SPm have been horizontally placed in a line to produce a loudspeaker array, a loudspeaker array may be a collection of loudspeakers placed in a vertical plane into a matrix having a plurality of rows by a plurality of columns. The loudspeakers SP1 to SPm may be placed in a cross-like or inverted T-shaped configuration. Due to the auditory characteristics that the auditory sensitivity or identification performance is high in the horizontal direction and is low in the vertical direction, the number of vertically placed loudspeakers may be reduced.

While the loudspeakers SP1 to SPm and the wavefront-synthesis surface SSR have been parallel to each other, they may not necessarily be parallel to each other. The loudspeakers SP1 to SPm may not be placed in a line or in a plane. When the loudspeakers SP1 to SPm are integrated with an audio and visual (AV) system or the like, the loudspeakers SP1 to SPm may be placed on the left, right, top and bottom of a display in a frame-like configuration, or may be placed on the bottom or top, left, and right of the display in a U-shaped or inverted U-shaped configuration.

While the yaw angle θ is changed by 5° stepwise by operating the operation switch 22, the yaw angle θ may be sequentially changed according to an output of a potentiometer or the like that is operated by the listener, or may automatically be changed as the target listener moves. An embodiment of the present invention can also be applied to a rear loudspeaker or a side loudspeaker, or to a loudspeaker system adapted to output sound waves in the vertical direction. An embodiment of the present invention can be combined with a general two-channel stereo or 5.1-channel audio system.

It should be understood to hose skilled in the art that various modifications, combinations, sub-combinations and alterations may occur depending on design requirements and other factors insofar as they are within the scope of the appended claims or the equivalents thereof.

What is claimed is:

1. A method for reproducing an audio signal, comprising the steps of:

producing a virtual sound source at an infinite distance from a loudspeaker array by performing wavefront synthesis with the loudspeaker array; and pivoting a sound wave emission direction of the virtual sound source about a fixed pivot point of the loudspeaker array to emit a first sound wave in a first direction from the virtual sound source followed by a second sound wave in a second direction from the virtual sound source.

2. The method according to claim 1, wherein the virtual sound source is a first virtual sound source, and wherein the method further comprises the steps of:

producing a second virtual sound source at an infinite distance from the loudspeaker array by performing wavefront synthesis with the loudspeaker array; and aligning the sound wave emission direction of the first virtual sound source with a sound wave emission direction of the second virtual sound source by performing wavefront synthesis with the loudspeaker array.

3. The method of claim 2, wherein the first virtual sound source is a source of left channel audio and wherein the second virtual sound source is a source of right channel audio.

4. The method of claim 1, wherein pivoting the sound wave emission direction comprises delaying an audio signal supplied to the loudspeaker array by a plurality of different time delays to produce a plurality of delayed audio signals.

5. The method of claim 4, wherein the audio signals of the plurality of delayed audio signals are digital signals, and wherein the method further comprises converting the plurality of delayed audio signals into analog signals and supplying the analog signals to a plurality of power amplifiers.

6. The method of claim 5, wherein each of the plurality of power amplifiers is coupled to one loudspeaker of the loudspeaker array.

7. The method of claim 4, wherein delaying an audio signal supplied to the loudspeaker array by a plurality of different time delays is performed using a plurality of delay circuits, and wherein the method further comprises supplying delay information to the plurality of delay circuits from a microcomputer.

8. A method for reproducing an audio signal, comprising the steps of:

setting an emission direction of a virtual sound source corresponding to a loudspeaker array by setting values of a plurality of time delay periods applied to audio signals received by the loudspeaker array and used to produce a plurality of delayed signals played by the loudspeaker array; and pivoting an emission direction of the virtual sound source about a fixed pivot point of the loudspeaker array by altering at least some of the values of the time delay periods.

9. An apparatus for reproducing an audio signal, comprising:

a first processing circuit adapted to process audio signals using wavefront synthesis to produce first processed signals which, when played by a loudspeaker array, produce a first virtual sound source located separate from the loudspeaker array;

a first setting circuit adapted to supply data to the first processing circuit to set a position of the first virtual sound source at an infinite distance; and control means for pivoting an emission direction of the first virtual sound source about a fixed pivot point of the loudspeaker array.

10. The apparatus according to claim 9, further comprising:

a second processing circuit adapted to process audio signals using wavefront synthesis to produce second processed signals which, when played by the loudspeaker array, produce a second virtual sound source located separate from the loudspeaker array; and a second setting circuit adapted to supply data to the second processing circuit to set a position of the second virtual sound source at an infinite distance, wherein the control means sets the emission direction of the first virtual sound source and an emission direction of the second virtual sound source to be parallel to each other.

11. An apparatus for reproducing an audio signal, comprising:

a plurality of delay circuits adapted to delay audio signals by predetermined delay periods of time to produce a plurality of delayed signals;

a plurality of outputting circuits adapted to supply the plurality of delayed signals to a plurality of loudspeakers that construct a loudspeaker array; and a control circuit adapted to alter the delay periods of time of the plurality of delay circuits to pivot an emission direction of the loudspeaker array about a fixed pivot point of the loudspeaker array.

12. An apparatus for reproducing an audio signal, comprising:

a first processing circuit adapted to process audio signals using wavefront synthesis to produce processed signals which, when played by a loudspeaker array, produce a first virtual sound source located separate from the loudspeaker array;

a first setting circuit adapted to supply data to the first processing circuit to set a position of the first virtual sound source at an infinite distance; and a control circuit adapted to pivot an emission direction of the first virtual sound source about a fixed pivot point of the loudspeaker array.

* * * * *